US006012582A

United States Patent [19]

Haygeman et al.

[11] Patent Number: 6,012,582

[45] Date of Patent: Jan. 11, 2000

[54] STACKABLE PACKAGING AND DISPLAY SYSTEM

[75] Inventors: Drew Haygeman, Carlsbad; Neil Nagy, San Pedro, both of Calif.

[73] Assignee: HIJK, Carlsbad, Calif.

[21] Appl. No.: 09/286,364

[22] Filed: Apr. 5, 1999

[51] Int. Cl.[7] ..... B65D 21/032

[52] U.S. Cl. ..... 206/503; 211/126.2; 211/128.1; 312/107

[58] Field of Search ..... 206/501, 503, 206/508, 509, 736, 740–744; 211/126.3, 128.1, 130.1, 133.1, 126.2; 220/4.27; 229/120.01; 248/174; 312/107, 111

[56] References Cited

U.S. PATENT DOCUMENTS

| | | | |
|---|---|---|---|
| 1,614,701 | 1/1927 | Webster | 211/130.1 |
| 1,731,950 | 10/1929 | Tanner | 211/128.1 |
| 1,739,623 | 12/1929 | Webster | 211/128.1 |
| 1,849,659 | 3/1932 | Burks | 312/107 |
| 3,224,822 | 12/1965 | Kirby | 206/503 |
| 4,550,837 | 11/1985 | Simmons | 211/128.1 |
| 4,708,240 | 11/1987 | McMahon et al. | 211/128.1 |
| 5,161,699 | 11/1992 | Hanna et al. | 211/130.1 |

*Primary Examiner*—Jim Foster

*Attorney, Agent, or Firm*—Kelly Bauersfeld; Lowry & Kelley, LLP

[57] ABSTRACT

A stackable packaging and display system is provided for containing items for display and/or sale, such as printer ink cartridges and the like. The packaging and display system includes a plurality of stackable modules formed from paperboard or the like, wherein each module comprises an upwardly open inner tray fitted slidably within an outer sleeve having an upper face relieved or cut back at a front end thereof to expose display items within the inner tray. One of the modules comprises a base module having a support stand on the underside thereof for supporting the base module in an orientation tilted angularly upwardly from the front end thereof. At least one additional module comprises an upper module having a mounting flap on the underside thereof for interlocking reception into a slot formed in the underlying module. With this arrangement, one or more upper modules are also supported in a tilted orientation and in a stacked sequence on the base module, with the front ends of the stacked modules disposed in a stacked array exposing the display items therein for customer access.

32 Claims, 8 Drawing Sheets

STACKABLE PACKAGING AND DISPLAY SYSTEM

BACKGROUND OF THE INVENTION

This invention relates generally to devices and systems for packaging and displaying items for sale in a retail store or the like. More specifically, this invention relates to an improved packaging and display system for containing a plurality of relatively small items for individual sale, particularly such as printer ink cartridges and/or other computer and office accessory items, wherein the display items are packaged in groups within modules adapted to be arranged quickly and easily in a stacked array with the display items exposed for convenient customer access and purchase.

Printer ink cartridges and other relatively small accessory items for use with computers and office equipment and the like are commonly displayed in a store facility in groups for customer selection and purchase. In this regard, such display items are typically packaged individually and boxed in relatively large cartons for shipment to the store, where a smaller group of the individually packaged items is then placed on a display counter or shelf, or hung from a display rack, for consumer access and sale. Over time, the displayed stock of each specific item is gradually depleted, whereby it is necessary for store personnel to monitor and regularly re-stock the display items. This process is labor intensive and costly. Moreover, the display of a group of relatively small individually packaged items does not provide significant product differentiation in terms of product identification and/or marketing information, beyond that which can be achieved by coloration and printing applied to the relatively small individual packages.

The present invention is directed to an improved display system for presenting a group of relatively small items such as printer ink cartridges and the like for consumer access, selection and sale, wherein the display items are packaged within modules suitable for convenient storage and shipment. At a store facility, the modules are adapted for quick and easy stacking to display a substantial number of the display items within a compact volumetric space. The modules may bear attractive product identification and marketing information, and further may be replaced quickly and easily by one or more replacement modules as the stock of display items is depleted.

SUMMARY OF THE INVENTION

In accordance with the invention, a stackable packaging and display system is provided for containing and displaying items for sale, such as printer ink cartridges and the like. The packaging and display system includes a plurality of modules formed from paperboard or the like, each containing a plurality of the display items for convenient shipment to and storage at a store facility or the like. The modules are adapted for quick and easy interlocking assembly in a stacked array, with the display items within each module exposed for convenient customer access. Distinctive product identification and marketing information may be applied to the modules for prominent display to and viewing by customers.

Each module comprises an upwardly open inner tray fitted slidably within an outer sleeve having an upper panel relieved or cut back at a front end thereof to expose display items within the inner tray. One of the modules comprises a base module having a support stand on the underside thereof for supporting the base module in an orientation tilted angularly upwardly from the front end thereof. In one preferred form, the support stand includes a fold-out leg and bracket formed in and adapted to fold downwardly and rearwardly from the underside of the associated outer sleeve and inner tray. In another preferred form, the support stand comprises a separate fold-out stand member attached as by an adhesive to the underside of the outer sleeve.

At least one additional module comprises an upper module having a mounting flap on the underside thereof for interlocking reception into a slot formed in the underlying module. In one preferred form, the mounting flap is formed integrally with a bottom panel of the outer sleeve, whereas in another preferred form the mounting flap may be separately attached as by an adhesive to the underside of the outer sleeve bottom panel. In either case, the mounting flap conveniently seats within a slot defined between the outer sleeve and inner tray at the rear end of the underlying module.

With this arrangement, one or more upper modules are supported in a tilted orientation and in a stacked sequence on the base module, with the front ends of all of the modules disposed in a vertically stacked array exposing the display items therein for customer access. As the display items are depleted over time, one or more empty modules may be replaced quickly and easily by replacement modules containing a fresh stock of the display items.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
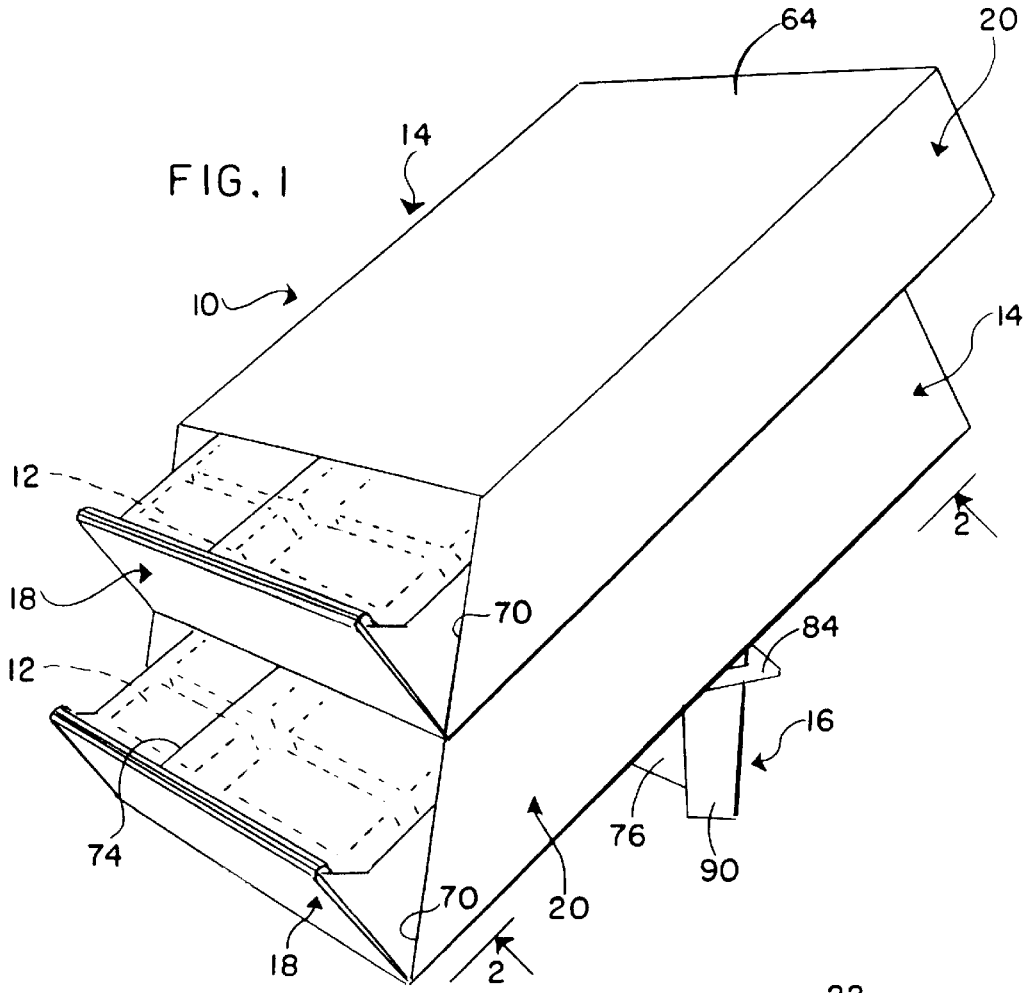
FIG. 1 is a perspective view illustrating one preferred form of the stackable packaging and display system of the present invention, to depict one upper module stacked upon a base module.

As shown in the exemplary drawings, a stackable packaging and display system referred to generally in FIG. 1 by the reference numeral 10 is provided for containing and displaying a group of relatively small items 12 for sale, particularly such as printer ink cartridges or other computer or office equipment accessory products and the like. The system 10 generally comprises a plurality of individual modules 14 each containing a plurality of the display items 12, wherein the modules 14 are designed for quick and easy deployment in a stacked array with the display items in each module exposed for convenient consumer access and sale.

The stackable packaging and display system 10 of the present invention provides a relatively simple and easily erected self-standing display case for supporting printer ink cartridges or other display items 12 in an attractive yet relatively compact and space-efficient manner on a counter top or shelf or the like in a store facility. The modules 14 are adapted to be constructed from lightweight paperboard and thus comprise a convenient shipping package within which the display items 12 can be transported to the store facility and retained in a suitable stock room or the like pending display for sale. The self-standing display case is erected by fold-out assembly of a support stand 16 on one of the modules 14, to form a lower or base module supported in a tilted orientation extending angularly upwardly from a front end thereof. One or more additional modules 14 are then mounted on the base module in a stacked and interlocked sequence, with each module tilting upwardly from a front end thereof. The multiple modules 14 are configured to expose the display items 12 contained therein at the module front ends, whereby the display items carried by the stacked modules are exposed in a stacked array for easy consumer access and selection. When the display items 12 are depleted from one or more of the stacked modules 14, such empty modules can be removed from the stacked display and substituted by replacement modules containing a fresh supply of the display items. Moreover, to enhance the visual distinctiveness and overall utility of the stacked display, each module 14 desirably bears suitable product identification and marketing information.

Figure 2:
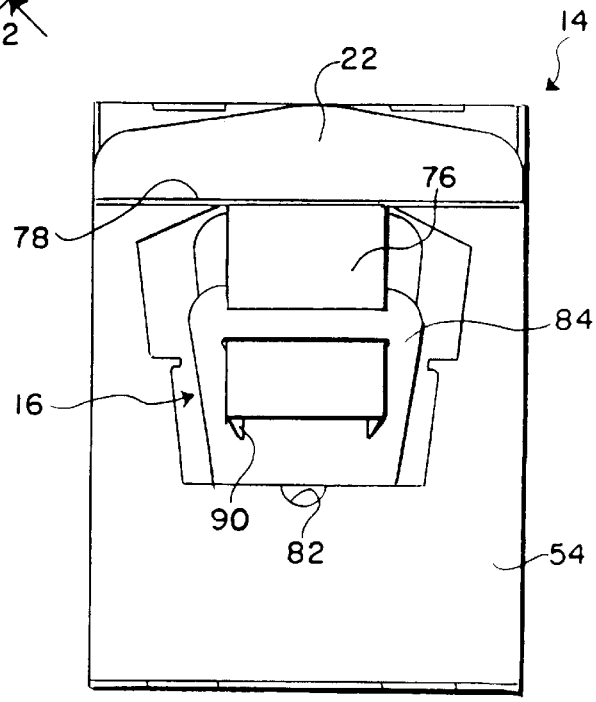
FIG. 2 is a bottom plan view of the base module in a deployed configuration, taken generally on the line 2—2 of FIG. 1.
Figure 3:
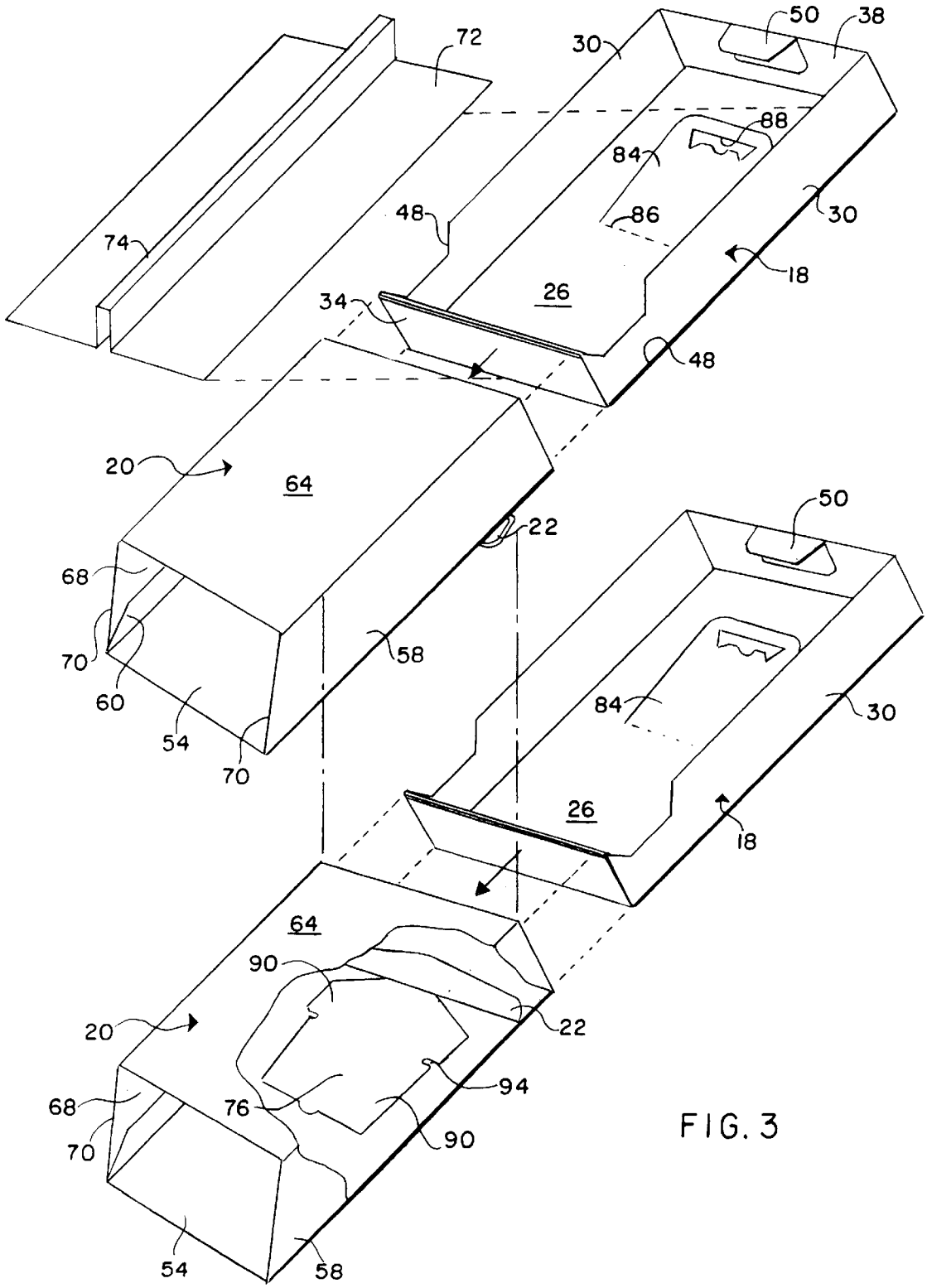
FIG. 3 is an exploded perspective view of the stacked modules of FIG. 1.

The stackable packaging and display system 10 is shown in FIGS. 1–5 in one preferred form comprising a plurality of the stackable modules 14 of identical construction. As shown, each of the modules 14 comprises an inner tray 18 of upwardly open construction to receive and support a group of the display items 12. The inner tray 18 is slidably fitted within an outer sleeve 20 having a top panel which is relieved or cut back at the front end to expose some of the display items 12 at the front end of the module 14. As shown in FIGS. 1 and 2, the lowermost or base module 14 in the stacked display has the support stand 16 deployed at the underside thereof to support the base module in the desired tilted orientation extending angularly upwardly from the module front end. FIGS. 1–3 show a single upper module 14 stacked onto the base module, and interlocked therewith by means of a mounting flap 22 located at the module underside near a rear end thereof. Persons skilled in the art will recognize and appreciate that one or more additional upper modules may be mounted in sequence onto the stacked display shown in FIG. 1.

Figure 4:
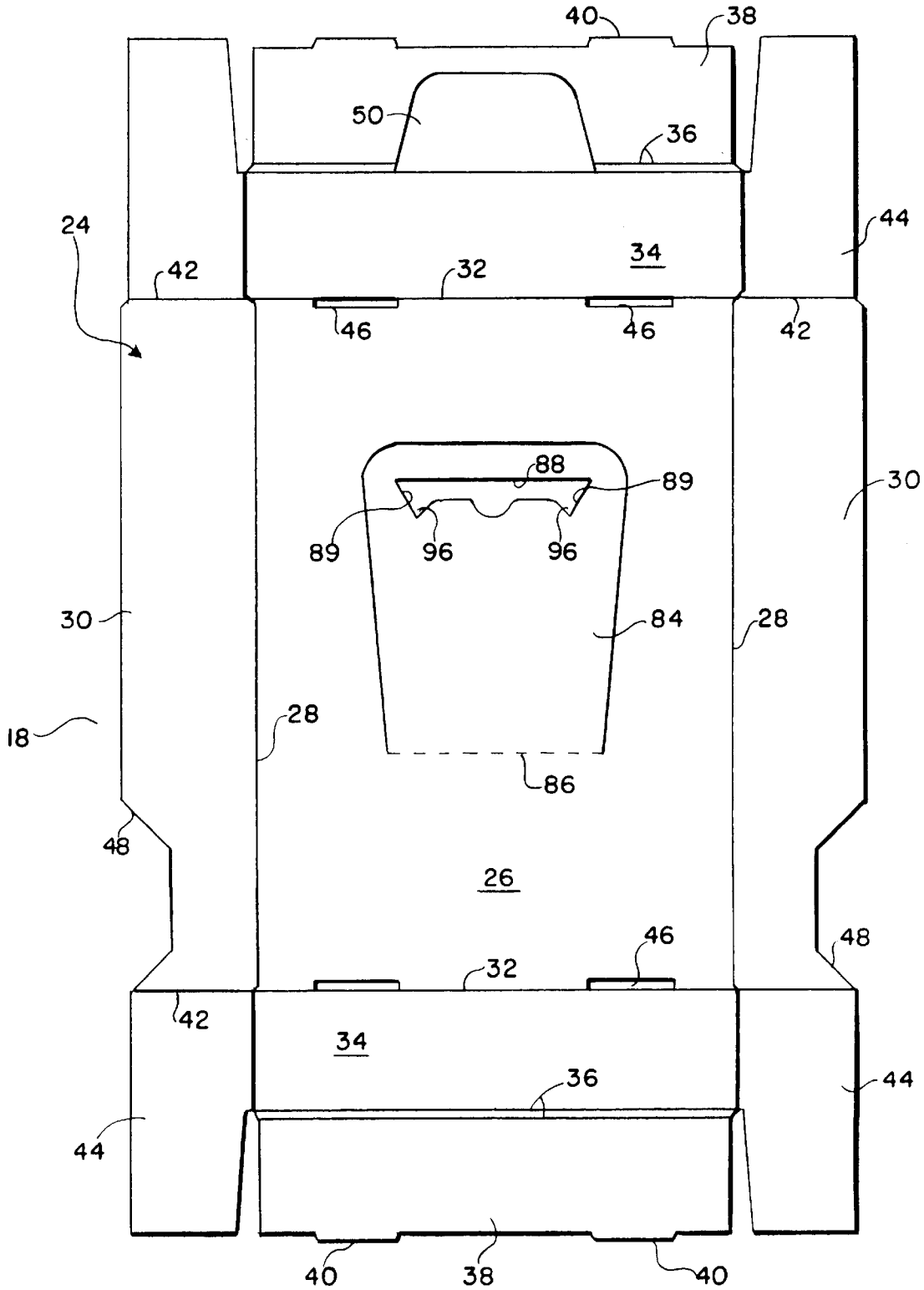
FIG. 4 is an enlarged plan view depicting a paperboard blank for use in forming an inner tray for one of the modules shown in FIGS. 1–3.

More specifically, with reference to FIG. 4, the inner tray 18 for each module 14 conveniently comprises a unitary blank 24 formed from lightweight paperboard or the like in a pre-cut and prescored configuration for quick and easy assembly. The tray blank 24 comprises a floor segment 26 of generally rectangular shape joined by scored fold lines 28 to a pair of side walls 30, and by a pair of scored fold lines 32 to a pair of end walls 34. These end walls 34 are respectively each joined in turn by a closely spaced parallel pair of additional fold lines 36 to a corresponding pair of inner end wall flaps 38 having relatively short lock tabs 40 protruding outwardly from the distal margins thereof. In addition, the opposite ends of the two side walls 30 are joined by fold lines 42 to outwardly extending side wall flaps 44.

The inner tray 18 is erected from the tray blank 24 by folding the side walls 30 along the fold lines 28 to upstand relative to the floor segment 26. The outwardly extending side wall flaps 44 are then folded inwardly at the opposite ends of the floor segment 26, generally in overlying relation to the end wall fold lines 32. The end walls 34 are then folded along the fold lines 32 to upstand at an outboard face of the side wall flaps 44, followed by folding the inner end wall flaps 38 along the sets of double fold lines 36 to extend downwardly at an inboard face of the side wall flaps 44. In this geometry, the lock tabs 40 on the inner end wall flaps 38 are positioned for seated reception into aligned lock ports 46 formed in or along the end wall fold lines 32 to form the upwardly open tray 18 (as viewed in FIG. 3). Conveniently, for improved customer access to display items 12 contained within the tray 18, as will be described in more detail, the upper marginal edges of the side walls 30 desirably include shallow recesses 48 near a front end of the tray 18. In addition, if desired, a retention flap 50 may be cut from the inner end wall flap 38, at a rear end of the tray 18.

Figure 5:
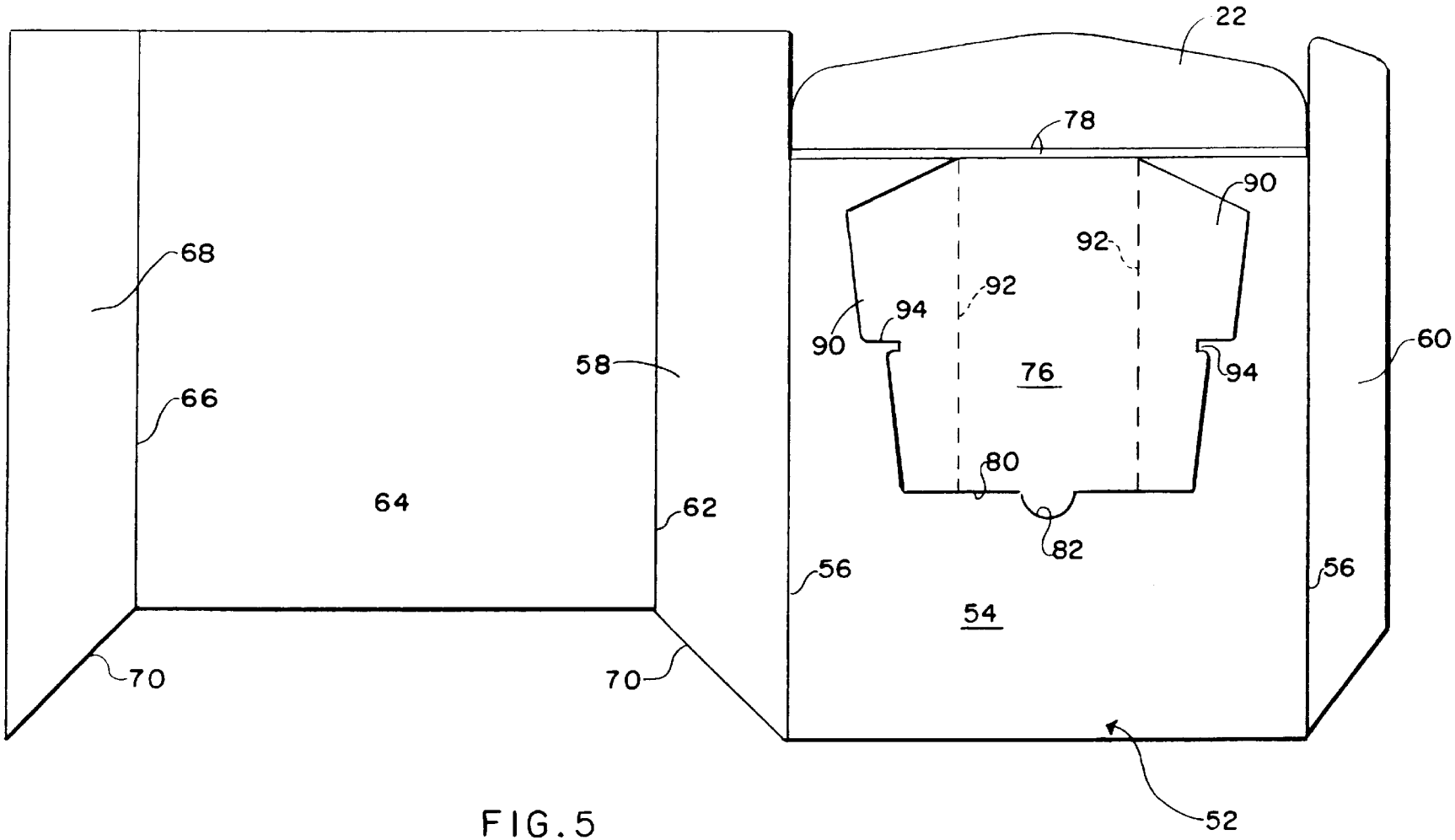
FIG. 5 is an enlarged plan view depicting a paperboard blank for use in forming an outer sleeve for one of the modules shown in FIGS. 1–3.
Figure 6:
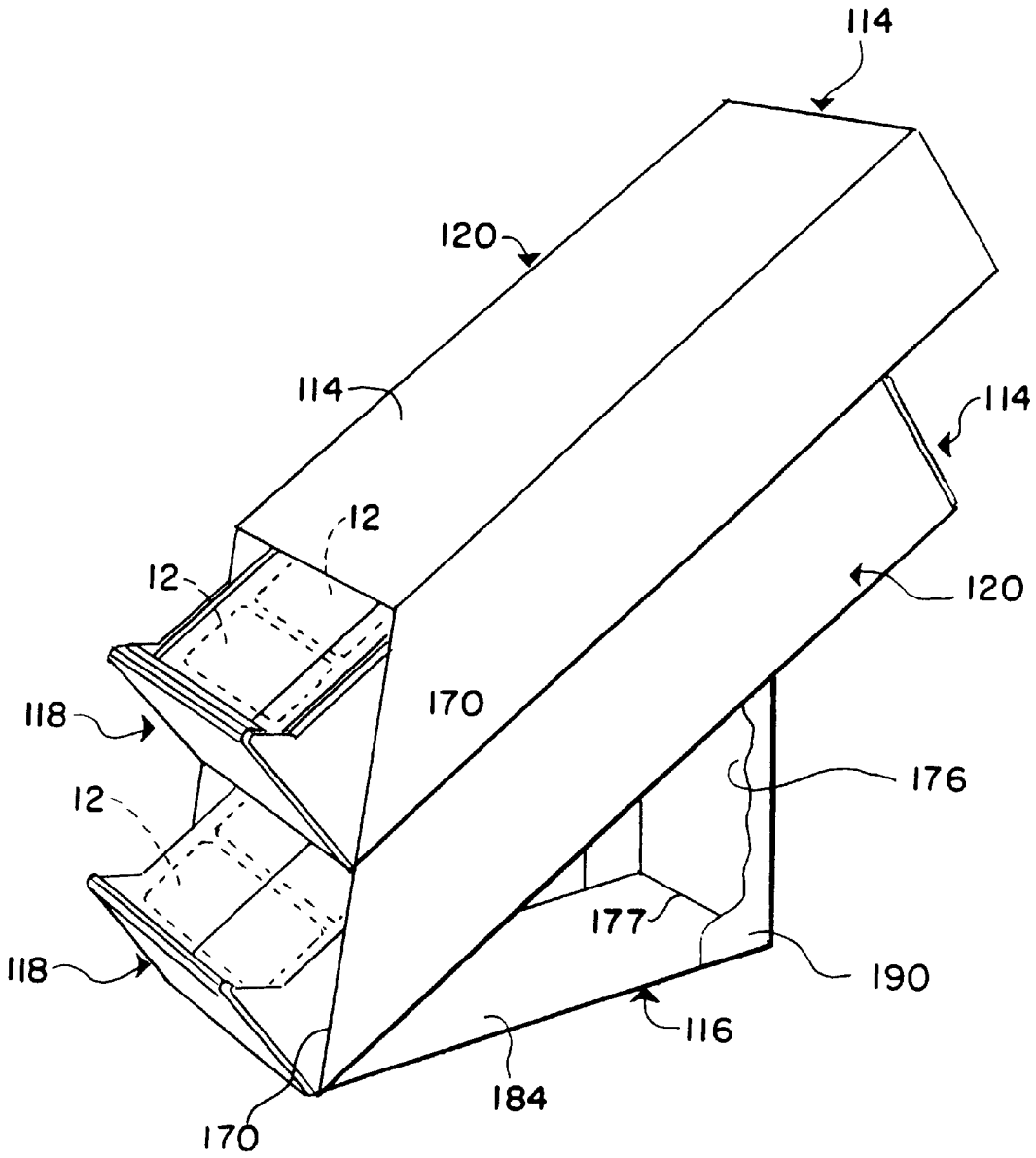
FIG. 6 is a perspective view illustrating an alternative preferred form of the stackable packaging and display system of the present invention, to depict one upper module stacked upon a base module.

FIG. 5 shows a unitary blank 52 formed from lightweight paperboard or the like in a pre-cut and pre-scored configuration for quick and easy assembly to form the outer sleeve 20 for each of the modules 14. As shown, this sleeve blank 52 comprises a bottom panel 54 having a generally rectangular size and shape joined respectively along opposite side edges by a pair of scored fold lines 56 to a first side panel 58 and also to an attachment strip 60 of comparatively shorter height. The first side panel 58 is joined in turn by another fold line 62 to a top panel 64 of generally rectangular shape, the opposite side edge of which is joined by a fold line 66 to a second side panel 68. Importantly, the top panel 64 has a width dimension generally corresponding to the width of the bottom panel 54, but the front ends of the two side panels 58, 68 are relieved or cut back as shown by the angularly set front edges 70, so that a forward margin of the top panel 64 is set back or spaced rearwardly from the associated underlying forward margin of the bottom panel 54.

The outer sleeve 20 of the stackable module 14 is assembled by folding the first side panel 58 and the attachment strip 60 along the fold lines 56 to extend upwardly with respect to the bottom panel 54. The top panel 64 is then folded on the line 62 over the bottom panel 54 into generally parallel relation therewith, and the second side panel 68 is folded on the line 66 to extend along an outboard side of the attachment strip 60. The second side panel 68 and the attachment strip 60 are suitably interconnected as by means of an adhesive or stapled attachment to retain the outer sleeve 20 in a hollow sleeve-like configuration (as viewed in FIG. 3) for slide-fit mounting over the associated inner tray 18. The display items 12 can be loaded into the tray quickly and easily prior to assembly with the outer sleeve 20. In this regard, a liner sheet 72 as depicted in FIG. 3 folded to define a central longitudinal divider 74 may be seated within the tray 18 prior to placement of the display items 12 therein, to assist in maintaining the display items within the tray in an orderly arrangement.

The support stand 16 is formed at the underside of the assembled module 14. More particularly, in the preferred configuration as shown in FIGS. 1–5, the support stand 16 may comprise fold-out elements formed as portions of the assembled inner tray 18 and outer sleeve 20. A fold-out leg 76 is shown cut from the bottom panel 54 of the sleeve 20, with one end of the fold-out leg 76 joined to the sleeve 20 in a central region along one of a pair of closely spaced parallel fold lines 78 near a rear end of the sleeve. The fold-out leg 76 can thus be pivoted downwardly and rearwardly from the plane of the bottom panel 54, to extend generally vertically therefrom with a lowermost margin 80 for engaging a horizontal support surface such as a counter top or shelf. An open port 82 may be formed in the bottom panel 54 adjacent the leg margin 80 to facilitate fingertip grasping of the leg for fold-out movement, as described.

The support stand 16 additionally comprises an anchor bracket 84 shown cut from the floor segment 26 of the tray 18, with one end of the anchor bracket 84 joined to the floor segment 26 in a central region along a fold line 86. This anchor bracket 84 is designed to pivot downwardly and rearwardly from the plane of the floor segment 26, subsequent to the above described vertical deployment of the fold-out leg 76, to a substantially horizontal orientation. A central opening 88 is formed in the anchor bracket 84 near a rear or distal end thereof, wherein this opening 88 accommodates fingertip grasping for downward and rearward folding of the bracket. This central opening 88 is also sized and shaped for pass-through reception of the fold-out leg 76 to provide a relative stable support stand construction for supporting the module 14 in a tilted orientation extending angularly upwardly from a front end thereof. The opposite ends of the central opening 88 are angularly set as indicated by reference numeral 89 to engage and retain a pair of side wings 90 formed along opposite side edges of the fold-out leg 76 in an orientation turned forwardly and inwardly along fold lines 92. In addition, for further stability, the free edge margins of these side wings 90 may include notches 94 for interlocking with an interior edge 96 of the anchor bracket 84.

The individual module 14 with the support stand 16 deployed comprises the base module upon which one or more additional modules 14 can be stacked in sequence. In this regard, modules disposed in the stacked display above the base module will not have the support stand 16 deployed. Instead, the fold-out leg 76 and the anchor bracket 84 for the support stand 16 for each such upper module 14 will remain in the original undeployed position disposed co-planar with the bottom panel 54 of the sleeve 20 and with the floor segment 26 of the tray 18, respectively. However, each module 14 also includes the mounting flap 22 formed as a portion of the sleeve bottom panel 54 the rear end thereof, and pivotally foldable along the double fold lines 78 rearwardly back upon the bottom panel 54 for interlocking engagement with the underlying module in the stack. This mounting flap 22 is sized for slide-fit reception into a laterally extending slot defined between a rear end of the outer sleeve 20 and the rear end of the tray 18 fitted therein. The retention flap 50 on the rear end of the tray 18 assists in guiding and retaining the mounting flap 22 into this slot, in a position above display items 12 contained in the underlying tray.

With this construction, the fold lines 78 associated with the mounting flap 22 of each upper module 14 are generally aligned with a rear marginal edge of the sleeve top panel 64 on the immediately underlying module 14 in the display stack. Accordingly, the front end of each upper module is set back or spaced rearwardly from the front end of the immediately underlying module, as viewed in FIG. 1, whereby the exposed display items 12 at the front ends of the stacked modules 14 are arranged in a vertically spaced array for easy customer access. In the preferred form, the stacked modules can be formed with the angularly cut side edges 70 on the respective outer sleeves 20 arranged in an attractive line extending vertically and slightly rearwardly, as shown in FIG. 1.

The display items 12 such as computer printer ink cartridges or the like are thus exposed to customers for selection and purchase. When the supply of display items within one or more of the stacked modules 14 is depleted, the stacked display can be disassembled quickly and easily to permit removal of each empty module, followed by re-assembly using one or more replacement modules pre-loaded with the display items. In this regard, such replacement modules provide a convenient package for transporting a substantial number of the display items from a stock room or the like to the display site whereat the modules are then integrated directly into the stacked display within requiring further individual handling or processing of the display items by store personnel. In the stacked configuration for display, the outer sleeves 20 of the stacked modules 14 and especially the top panel 64 of the uppermost module in the stack provide extensive surface area for attractive and/or colorful product identification and marketing information.

One alternative preferred form of the stackable packaging and display system of the present invention is shown in FIGS. 6–12, wherein stackable modules 114 are provided with a support stand 116 and a mounting flap 122 of modified construction. For sake of convenience and ease of description, structural components of the modules 114 (FIGS. 6–12) which correspond in structure and function to the embodiment of FIGS. 1–5 are identified by common reference numerals increased by 100. In general, the stackable modules 114 of FIGS. 6–12 each comprise an inner tray 118 loaded with display items 12 and slidably fitted within an outer sleeve 120, but wherein the support stand 116 is separately mounted only on the lowermost or base module in the stacked display. Similarly, the mounting flap 122 is separately mounted on each upper module in the stacked display, but is not mounted onto the base module.

Figure 7:
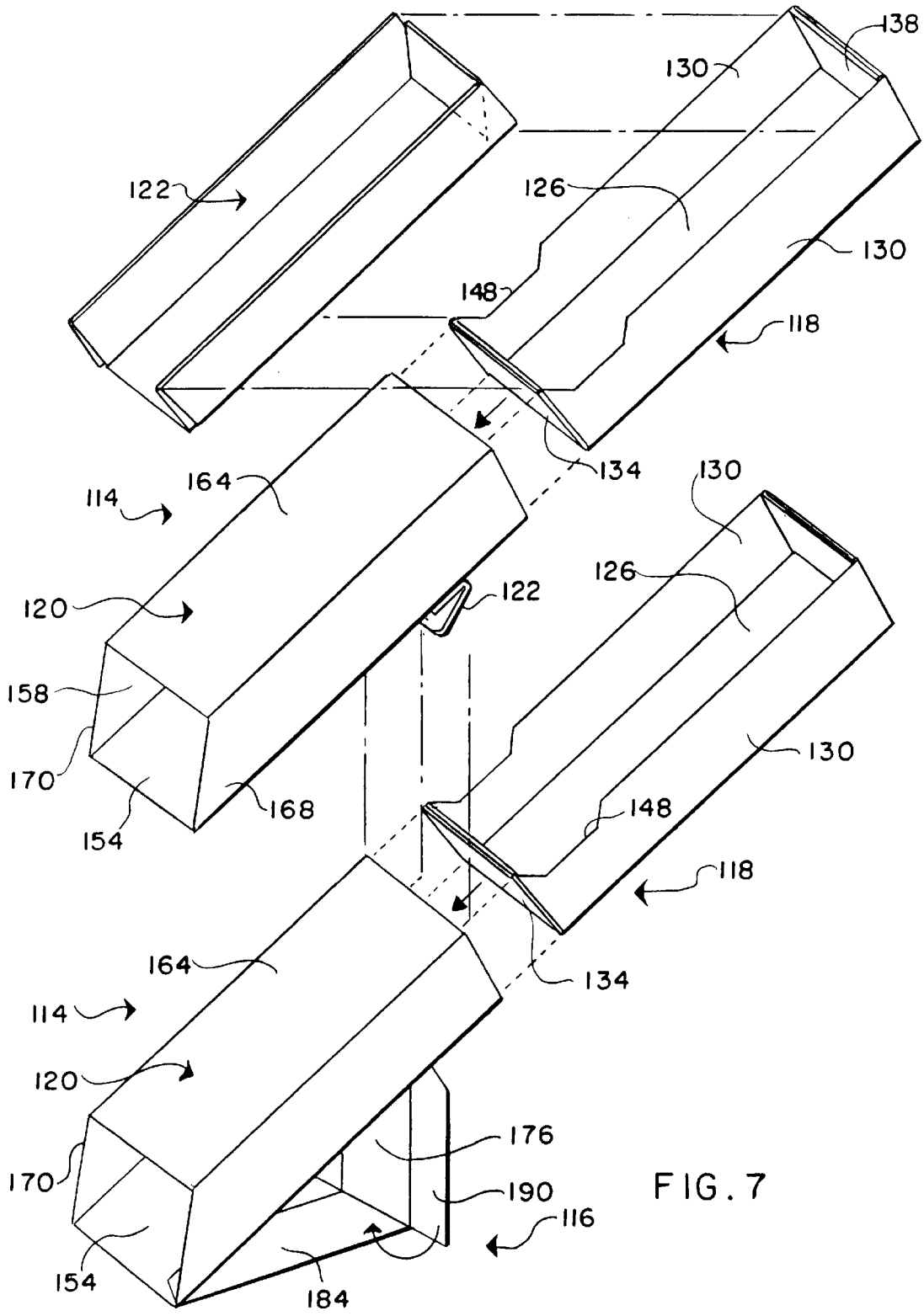
FIG. 7 is an exploded perspective view of the stacked modules of FIG. 6.
Figure 8:
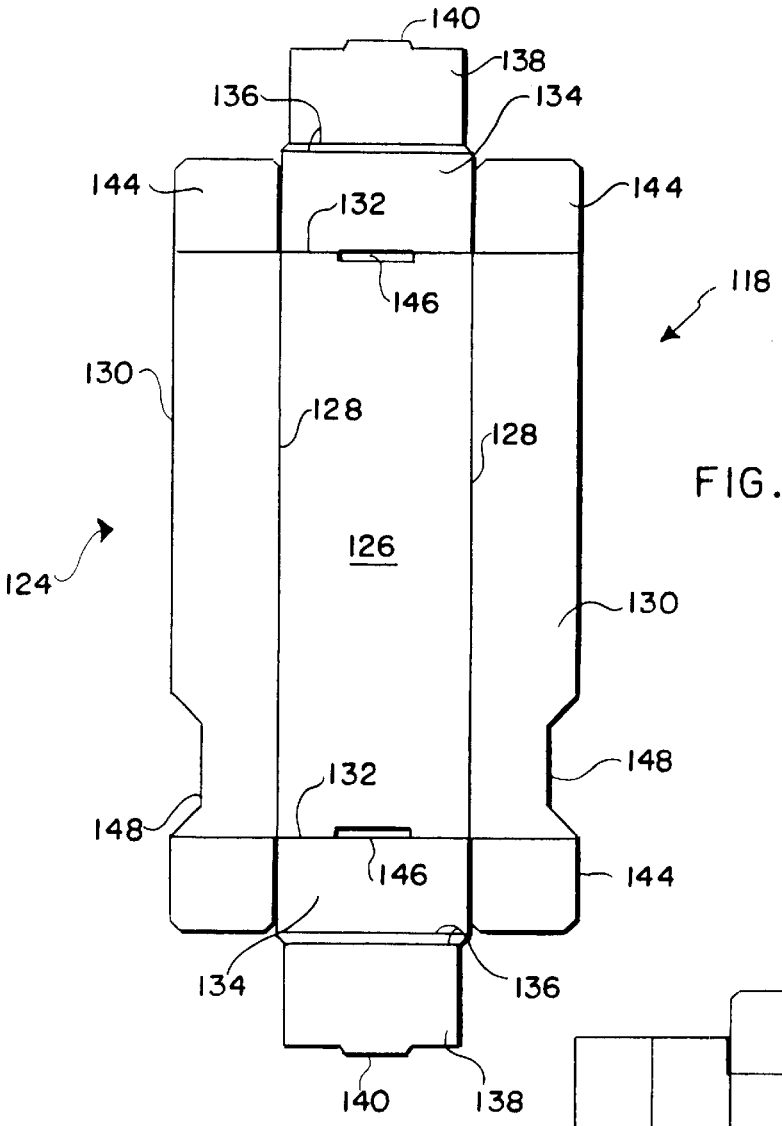
FIG. 8 is a plan view depicting a paperboard blank for use in forming an inner tray for one of the modules of FIGS. 6–7.
Figure 9:
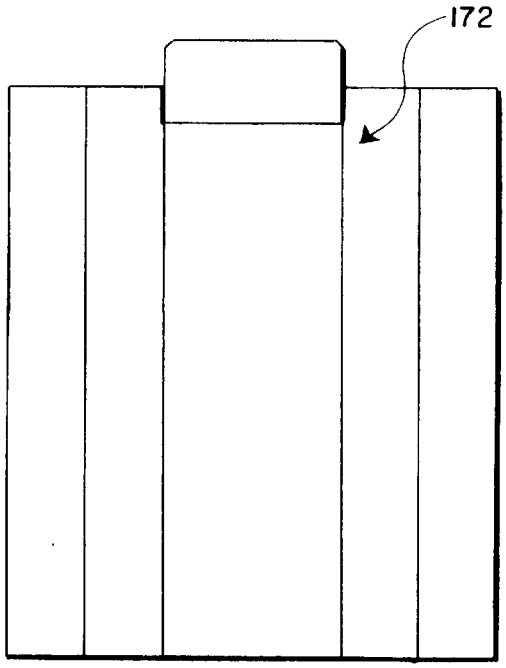
FIG. 9 is a plan view depicting a paperboard blank for use in forming an inner liner for one of the modules of FIGS. 6–7.

FIG. 8 shows a paperboard blank 124 for the inner tray 118. The blank 124 comprises a floor segment 126 joined along opposite side edges by fold lines 128 to a pair of side walls 130, and along opposite end edges by fold lines 132 to a pair of end walls 134. These end walls 134 are joined in turn by sets of double fold lines 136 to inner end wall flaps 138 having lock tabs 140 at the distal ends thereof for seated reception into lock ports 146 at opposite ends of the floor segment 126. The end walls 134 and inner end wall flaps 138 fold over side wall flaps 144 at opposite ends of the side walls 130 in the course of erecting the tray 118, in the same manner as previously described with respect to the embodiment of FIGS. 1–5. An inner liner sheet 172 for the tray may also be provided, as shown in FIGS. 7 and 9, in the form of a folded paperboard sheet seated within the upwardly open tray 118 to define a one or more longitudinally open slide channels for display items with the tray to slide downwardly and forwardly to the front end thereof.

Figure 10:
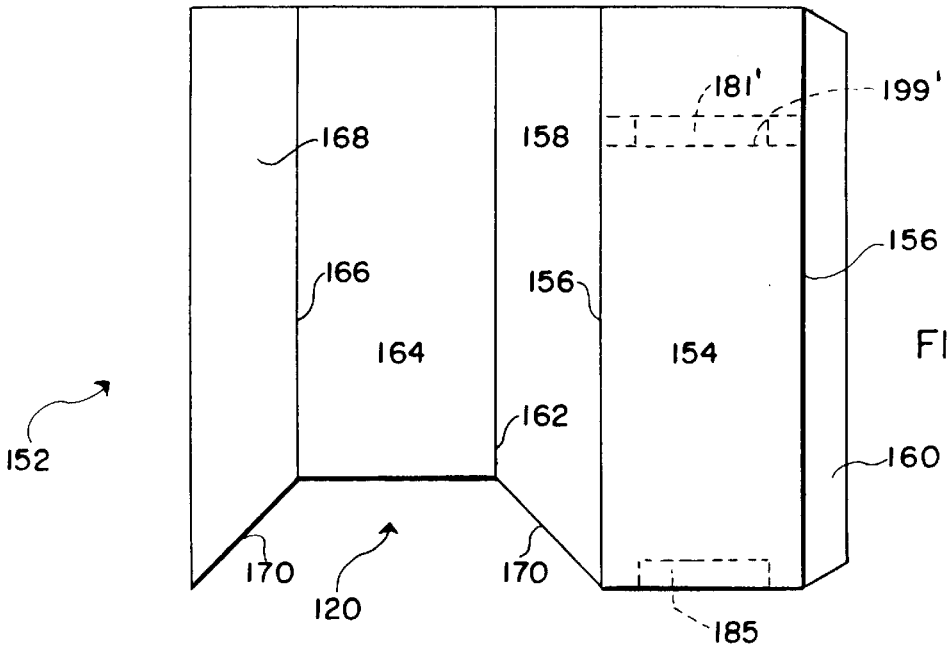
FIG. 10 is a plan view depicting a paperboard blank for use in forming an outer sleeve for one of the modules of FIGS. 6–7.

FIG. 10 illustrates a paperboard blank 152 for the outer sleeve 120. The blank 152 comprises a bottom panel 154 joined along opposite side edges by fold lines 156 to a first side panel 158 and to a smaller attachment strip 160. The first side panel 158 is joined by another fold line 162 to a top panel 164, which is joined in turn by a fold line 166 to a second side panel 168. The sleeve 120 is erected by suitably securing the attachment strip 160 to an inboard face of the second side panel 168, in the same manner as previously described with respect to the embodiment of FIGS. 1–5, followed by slide-fit assembly of the outer sleeve 120 with the inner tray 118 loaded with display items 12. The front edges of the side panels 158, 168 are angularly cut back as indicated by reference numerals 170 to set back or relieve the front margin of the top panel 164, to expose the display items at the front end of the tray 118, and the tray side walls 130 may conveniently include recesses 148 therein for better customer access to the display items.

Figure 11:
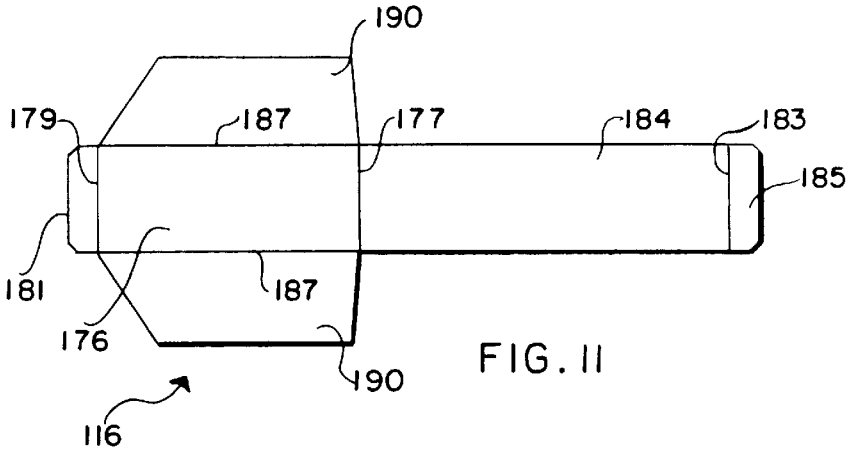
FIG. 11 is a plan view depicting a paperboard blank for use in forming a fold-out support stand for the base module shown in FIGS. 6–7.

The support stand 116 is shown in FIG. 11 in the form of a precut and pre-scored paperboard blank adapted for quick and easy assembly with the module 14 selected for use as the base module in a stacked display. As shown, the support stand 116 comprises a support leg 176 joined at one end by a fold line 177 with an anchor bracket 184. The opposite end of the support leg 176 is joined by a fold line 179 to a short attachment tab 181, whereas the opposite end of the anchor bracket 184 is joined at a fold line 183 to another attachment tab 185. In addition, the support leg 176 is connected along the side edges thereof by a pair of fold lines 187 to a pair of side wings 190.

The attachment tabs 181, 185 on the support stand 116 are quickly and easily attached by a suitable adhesive or the like to the underside of the sleeve bottom panel 154, as respectively depicted in FIG. 10 by the dotted line regions 181' and 185'. Such connection of the attachment tabs 181, 185 to the outer sleeve 120 orients the support leg 176 and the anchor bracket 184 in a substantially perpendicular configuration (FIGS. 6 and 7) for supporting the base module 114 in a tilted orientation extending angularly upwardly and rearwardly from a front end thereof. The side wings 190 can then be pivoted on the fold lines 187 to extend forwardly beneath the supported module, to provide the support stand 116 with substantial vertical load capacity and stability.

Figure 12:
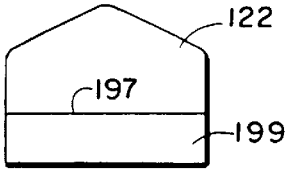
FIG. 12 is a plan view depicting a paperboard blank for use in forming a mounting flap for the upper module shown in FIGS. 6–7.

Each upper module 114 to be stacked in sequence upon the base module is equipped with a mounting flap 122. In this regard, FIG. 12 shows the mounting flap 122 in the form of a paperboard blank joined along a fold line 197 with an attachment tab 199. The attachment tab 199 is fastened quickly and easily by a suitable adhesive or the like to the underside of the sleeve bottom panel 154 near a rear end of the outer sleeve, as depicted in FIG. 10 by the dotted line region 199'. The mounting flap 122 is then pivoted on the fold line 197 for locking engagement with the underlying module in the stacked display. In particular, the mounting flap 122 has a size and shape for seated reception into a laterally extending slot defined at the rear end of the underlying module 114 between the outer sleeve 120 and the tray 118 therein. In the stacked display (FIG. 6), the display items contained within each module 114 are exposed at the front ends thereof for facilitated customer access. Upper modules 114 can be quickly and easily interchanged with replacement modules as the supply of display items in one or more upper modules is depleted, all as previously described with respect to the embodiment of FIGS. 1–5.

A variety of further modifications and improvements in and to the stackable packaging and display system of the present invention will be apparent to those persons skilled in the art. Accordingly, no limitation in or to the invention is intended by way of the foregoing description and accompanying drawings, except as set forth in the appended claims.

What is claimed is:

1. A stackable packaging and display system, comprising:

at least two modules each comprising an upwardly open tray for receiving and supporting items for display, and an outer sleeve having said tray slide-fitted therein, said outer sleeve having a front end relieved to expose and display items disposed generally at a front end of said tray;

a support stand for supporting one of said modules in a tilted orientation extending upwardly and rearwardly from said front end thereof, said one of said modules comprising a base module; and means on each remaining module for interlocking in stacked sequence on said base module in a tilted orientation extending upwardly and rearwardly from said front end thereof, whereby said front ends of said at least two modules are arranged in a substantially vertically stacked array with the display items exposed therein.

2. The stackable packaging and display system of claim 1 wherein said support stand is formed from paperboard.

3. The stackable packaging and display system of claim 1 wherein said interlocking means comprises a mounting flap on each remaining module.

4. The stackable packaging and display system of claim 1 wherein said outer sleeve of each of said modules is formed from paperboard.

5. The stackable packaging and display system of claim 1 wherein said tray of each of said modules is formed from paperboard.

6. The stackable packaging and display system of claim 1 wherein said outer sleeve of each of said modules is formed from paperboard to include a bottom panel and a top panel separated along opposite side edges by a pair of side panels, said side panels having angularly set front edges extending angularly rearwardly and upwardly from a front end of said bottom panel to a front end of said top panel, whereby said top panel front end is set back from said front end of said bottom panel.

7. The stackable packaging and display system of claim 6 wherein said tray of each of said modules is formed from paperboard to include a floor segment bounded along opposite side edges by a pair of upstanding side walls and along opposite end edges by a pair of upstanding end walls, said tray having a size and shape for slide-fit reception into said outer sleeve.

8. The stackable packaging and display system of claim 7 wherein said side walls of said tray have recesses formed in the upper edges thereof at a location generally adjacent said tray front end for facilitated access to display items within said tray.

9. The stackable packaging and display system of claim 7 wherein said support stand comprises fold-out members formed as portions of said outer sleeve bottom panel and said tray floor segment.

10. The stackable packaging and display system of claim 9 wherein said fold-out members comprise a fold-out leg formed as a portion of said bottom panel to fold downwardly and rearwardly from the plane of said bottom panel, and an anchor bracket formed as a portion of said floor segment to fold downwardly from the plane of said floor segment, said fold-out leg and said anchor bracket including means for locking interconnection.

11. The stackable packaging and display system of claim 10 further including at least one side wing carried by said fold-out leg and foldable with respect thereto to extend generally forwardly from said fold-out leg beneath said base module.

12. The stackable packaging and display system of claim 11 wherein said anchor bracket further includes means for retaining said at least one side wing to extend generally forwardly when said anchor bracket is lockingly interconnected with said fold-out leg.

13. The stackable packaging and display system of claim 10 wherein said interlocking means comprises a mounting flap formed as a portion of said outer sleeve bottom panel at a position generally adjacent a rear end thereof, said mounting flap being foldable back upon said bottom panel and insertable into a slot defined by the immediately underlying module between the rear ends of said outer sleeve and said tray thereof.

14. The stackable packaging and display system of claim 6 wherein said interlocking means comprises a mounting flap formed as a portion of said outer sleeve bottom panel at a position generally adjacent a rear end thereof, said mounting flap being insertable into a slot defined by the immediately underlying module between the rear ends of said outer sleeve and said tray thereof.

15. The stackable packaging and display system of claim 6 wherein said support stand comprises a paperboard stand mounted to an underside of said outer sleeve bottom panel of said base module, said paperboard stand including a support leg extending generally downwardly from said bottom panel to support said base module in said tilted orientation, and an anchor bracket for retaining said support leg relative to said bottom panel.

16. The stackable packaging and display system of claim 15 further including at least one side wing carried by said support leg and foldable with respect thereto to extend generally forwardly from said support leg beneath said base module.

17. The stackable packaging and display system of claim 1 wherein said interlocking means comprises a mounting flap on the underside of each remaining module at a position generally adjacent a rear end thereof, said mounting flap being insertable into a slot defined by the immediately underlying module between the rear ends of said outer sleeve and said tray thereof.

18. A stackable packaging and display system, comprising:

at least two modules each comprising an upwardly open tray for receiving and supporting items for display, and an outer sleeve having said tray slide-fitted therein, said outer sleeve having a front end relieved to expose and display items disposed generally at a front end of said tray;

said outer sleeve of each of said modules being formed from paperboard to include a bottom panel and a top panel separated along opposite side edges by a pair of side panels;

said tray of each of said modules being formed from paperboard to include a floor segment bounded along opposite side edges by a pair of upstanding side walls and along opposite end edges by a pair of upstanding end walls, said tray having a size and shape for slide-fit reception into said outer sleeve;

a support stand for supporting one of said modules in a tilted orientation extending upwardly and rearwardly from said front end thereof, said one of said modules comprising a base module; and means on each remaining module for interlocking in stacked sequence on said base module in a tilted orientation extending upwardly and rearwardly from said front end thereof, whereby said front ends of said at least two modules are arranged in a substantially vertically stacked array with the display items exposed therein.

19. The stackable packaging and display system of claim 18 wherein said outer sleeve side panels have angularly set front edges extending angularly rearwardly and upwardly from a front end of said bottom panel to a front end of said top panel, whereby said top panel front end is set back from said front end of said bottom panel.

20. The stackable packaging and display system of claim 18 wherein said side walls of said tray have recesses formed in the upper edges thereof at a location generally adjacent said tray front end for facilitated access to display items within said tray.

21. The stackable packaging and display system of claim 18 wherein said support stand comprises fold-out members formed as portions of said outer sleeve bottom panel and said tray floor segment.

22. The stackable packaging and display system of claim 21 wherein said fold-out members comprise a fold-out leg formed as a portion of said bottom panel to fold downwardly and rearwardly from the plane of said bottom panel, and an anchor bracket formed as a portion of said floor segment to fold downwardly from the plane of said floor segment, said fold-out leg and said anchor bracket including means for locking interconnection..

23. The stackable packaging and display system of claim 22 further including at least one side wing carried by said fold-out leg and foldable with respect thereto to extend generally forwardly from said fold-out leg beneath said base module.

24. The stackable packaging and display system of claim 23 wherein said anchor bracket further includes means for retaining said at least one side wing to extend generally forwardly when said anchor bracket is lockingly interconnected with said fold-out leg.

25. The stackable packaging and display system of claim 22 wherein said interlocking means comprises a mounting flap formed as a portion of said outer sleeve bottom panel at a position generally adjacent a rear end thereof, said mounting flap being foldable back upon said bottom panel and insertable into a slot defined by the immediately underlying module between the rear ends of said outer sleeve and said tray thereof.

26. The stackable packaging and display system of claim 18 wherein said interlocking means comprises a mounting flap formed as a portion of said outer sleeve bottom panel at a position generally adjacent a rear end thereof, said mounting flap being insertable into a slot defined by the immediately underlying module between the rear ends of said outer sleeve and said tray thereof.

27. The stackable packaging and display system of claim 18 wherein said support stand comprises a paperboard stand mounted to an underside of said outer sleeve bottom panel of said base module, said paperboard stand including a support leg extending generally downwardly from said bottom panel to support said base module in said tilted orientation, and an anchor bracket for retaining said support leg relative to said bottom panel.

28. The stackable packaging and display system of claim 27 further including at least one side wing carried by said support leg and foldable with respect thereto to extend generally forwardly from said support leg beneath said base module.

29. A stackable packaging and display system, comprising:

at least one module comprising an upwardly open tray for receiving and supporting items for display, and an outer sleeve having said tray slide-fitted therein, said outer sleeve having a front end relieved to expose and display items disposed generally at a front end of said tray;

said outer sleeve being formed from paperboard to include a bottom panel and a top panel separated along opposite side edges by a pair of side panels;

said tray being formed from paperboard to include a floor segment bounded along opposite side edges by a pair of upstanding side walls and along opposite end edges by a pair of upstanding end walls, said tray having a size and shape for slide-fit reception into said outer sleeve;

a support stand for supporting said module in a tilted orientation extending upwardly and rearwardly from said front end thereof, said support stand comprising a fold-out leg formed as a portion of said bottom panel to fold downwardly and rearwardly from the plane of said bottom panel, and an anchor bracket formed as a portion of said floor segment to fold downwardly from the plane of said floor segment for interlocking engagement with said fold-out leg; and flap means on said outer sleeve bottom panel for interlocking engagement with an additional underlying module in a stacked sequence.

30. The stackable packaging and display system of claim 29 wherein said outer sleeve side panels have angularly set front edges extending angularly rearwardly and upwardly from a front end of said bottom panel to a front end of said top panel, whereby said top panel front end is set back from said front end of said bottom panel.

31. The stackable packaging and display system of claim 29 wherein said side walls of said tray have recesses formed in the upper edges thereof at a location generally adjacent said tray front end for facilitated access to display items within said tray.

32. The stackable packaging and display system of claim 29 further including at least one side wing carried by said fold-out leg and foldable with respect thereto to extend generally forwardly from said fold-out leg beneath said module.

* * * * *